US009381980B1

(12) United States Patent
Rush, III

(10) Patent No.: US 9,381,980 B1
(45) Date of Patent: Jul. 5, 2016

(54) SYSTEMS AND METHODS FOR LAUNCHING AND RETRIEVING OBJECTS IN AQUATIC ENVIRONMENTS; PLATFORMS FOR AQUATIC LAUNCH AND RETRIEVAL

(71) Applicant: Oceangate, Inc., Woodinville, WA (US)

(72) Inventor: Richard Stockton Rush, III, Seattle, WA (US)

( * ) Notice: Subject to any disclaimer, the term of this patent is extended or adjusted under 35 U.S.C. 154(b) by 0 days.

(21) Appl. No.: 14/454,663

(22) Filed: Aug. 7, 2014

Related U.S. Application Data

(60) Provisional application No. 61/863,848, filed on Aug. 8, 2013.

(51) Int. Cl.
*B63B 35/00* (2006.01)

(52) U.S. Cl.
CPC ..... *B63B 35/00* (2013.01); *B63B 2736/00* (2013.01)

(58) Field of Classification Search
CPC ..... B63C 11/49; B63B 35/00; B63B 38/00
See application file for complete search history.

(56) References Cited

U.S. PATENT DOCUMENTS

| | | | | |
|---|---|---|---|---|
| 3,589,133 | A * | 6/1971 | Lowd et al. | 405/204 |
| 5,507,596 | A | 4/1996 | Bostelman et al. | |
| 5,707,174 | A * | 1/1998 | Garren | 405/159 |
| 5,971,665 | A * | 10/1999 | Hughes | 405/159 |
| 6,227,766 | B1 * | 5/2001 | Cook | 405/186 |
| 6,260,504 | B1 * | 7/2001 | Moles et al. | 114/312 |
| 6,352,389 | B1 * | 3/2002 | Rines et al. | 405/205 |
| 6,566,834 | B1 | 5/2003 | Albus et al. | |
| 6,990,919 | B1 * | 1/2006 | Calinawan | 114/315 |
| 7,000,560 | B2 * | 2/2006 | Wingett et al. | 114/322 |
| 7,183,742 | B2 * | 2/2007 | Potter et al. | 320/101 |
| 7,219,615 | B2 | 5/2007 | Merchant et al. | |
| 7,337,741 | B1 | 3/2008 | Ansay et al. | |
| 7,621,697 | B2 | 11/2009 | Steenhuis et al. | |
| 7,731,157 | B2 | 6/2010 | Davidson | |

(Continued)

FOREIGN PATENT DOCUMENTS

| | | | |
|---|---|---|---|
| WO | 2000/024004 | A1 | 4/2000 |
| WO | 2013/072690 | A1 | 5/2013 |

OTHER PUBLICATIONS

Kerby, Terry; "The Use of a Diver-Operated Launch, Recovery and Transport (LRT) Vehicle for Operations of the Submersible Pisces V," International Pacifica Scientific Diving, pp. 41-50; http://archive.rubicon-foundation.org (1991).

*Primary Examiner* — Benjamin Fiorello
(74) *Attorney, Agent, or Firm* — Ann W. Speckman

(57) ABSTRACT

Systems and methods for launching and retrieving payloads in aquatic environments employ a platform that is both floatable and submersible at the discretion of and/or under the control of a user, on which submersible objects to be launched, delivered to a subsea location and/or retrieved (the payload) may be located. The platform is generally maneuvered to a desired site in a buoyant, floating state and is submerged, with the payload coupled to the platform, at the desired site. One or more buoyant elements is coupled to the submersible platform by cable(s), line(s), chain(s) or other coupling mechanisms. When the platform is submerged, the one or more floatable element(s) remain at or in proximity to the sea surface and support the platform in a submerged condition. The platform has a relatively large mass and, when submerged, acts as a dampener, while the buoyant element(s) and associated line(s)/cable(s)/coupling mechanism(s) act, relative to the submerged platform, as classic spring.

20 Claims, 4 Drawing Sheets

(56) References Cited

U.S. PATENT DOCUMENTS

| | | | | |
|---|---|---|---|---|
| 7,978,806 | B1 * | 7/2011 | Hayman, III | 376/317 |
| 8,157,205 | B2 | 4/2012 | McWhirk | |
| 8,231,420 | B2 | 7/2012 | Lunde | |
| 8,471,396 | B2 | 6/2013 | Roddier et al. | |
| 2012/0034034 | A1 | 2/2012 | Xu | |

* cited by examiner

SYSTEMS AND METHODS FOR LAUNCHING AND RETRIEVING OBJECTS IN AQUATIC ENVIRONMENTS; PLATFORMS FOR AQUATIC LAUNCH AND RETRIEVAL

REFERENCE TO PRIORITY APPLICATION

This application claims priority to U.S. Provisional Patent Application No. 61/863,848, filed Aug. 8, 2013. The disclosure of the priority patent application is incorporated herein in its entirety.

TECHNICAL FIELD OF THE DISCLOSURE

The present disclosure relates to systems and methods for launching and retrieving objects in aquatic environments, and to platforms for accomplishing aquatic launches and retrievals. The disclosure relates, more particularly, to methods and systems for deploying and retrieving payloads such as submersible vehicles, equipment, and the like, used for subsea operations. More particularly yet, this disclosure relates to methods and systems that permit payloads to be safely and conveniently launched and retrieved in rough sea conditions and in disparate geographical locations without the need for personnel to be in the water and without the need for dedicated ships, cranes or other specialized, ship-dependent hardware or active platform buoyancy or other active depth control systems.

BACKGROUND OF THE INVENTION

In marine operations involving subsea work, it is often necessary to deploy a heavy structure, vehicle or piece of equipment in rough seas. Traditional deployment methods use various types of heavy cranes, heave compensation systems, reinforced cages/protective systems, "A" frames, moon pools and lowering decks. The heavy structure being deployed is typically mechanically coupled (directly or indirectly) to the heavy vessel deploying it, as the load is lowered into and retrieved from the water. The various deployment and retrieval systems attempt to resolve the fundamental problem of matching, or minimizing, the relative motion of two spatially separate but mechanically linked masses in a dynamic environment such as at the sea surface. Entry of the load into and exit of the load from a turbulent "splash zone" at and near the water surface can be treacherous and may damage the load or the launch/retrieval vessel, and may as well produce unsafe conditions for personnel and equipment in the area.

In one exemplary launch and recovery system disclosed in PCT International Patent Publication WO 2013/072690, a subsea payload is lifted from and deployed to an undersea location using a lift line supported by a heave-compensating winch on a surface vessel. Movement of a submersible latch unit is controlled by means of on-board thrusters. Vessel and crew time are expensive, and the expense incurred as a result of launch and retrieval vessel and crew requirements may limit the frequency of launch and retrieval operations, particularly in remote locations.

One system that avoids mechanically joining heavy dissimilar objects (such as a launch vessel and a submersible vessel or payload) at the splash zone places the vehicle or payload on a "sinking barge" and tows the barge/payload to a dive location, where both the barge and the payload are sunk, as a unit, under controlled conditions, generally using an active depth control system. The payload/vehicle is deployed by releasing it from the barge transport component at a desired depth where the sea conditions are steady and manageable. The few existing systems that use this type of subsurface launch and retrieval approach require the use of an active manually operated depth control system, and they generally require the use of divers to detach the vehicle from the barge during deployment and to re-attach the vehicle during retrieval. Personnel are also generally required to operate the active depth control system during launch and retrieval.

A submersible launch, recovery and transport vehicle (LRT) of the aforementioned type was developed for transporting and deploying research submarines in rough waters in connection with the Hawaii Undersea Research Laboratory (HURL). The LRT is a twin-hulled, submersible platform upon which a submarine may be positioned and secured. It is towed on the surface by a support vessel to a desired dive site, and the LRT and submarine are both submerged, under the control of a diver pilot, to maintain a stable hover at a depth of 50-60 feet. The submarine is released from the platform by diver(s), and the LRT maintains at hover awaiting return of the submarine, or returns to the surface. While this system allows subsea launch and retrieval of submersible vehicles from a sub-sea location that is isolated from surface conditions (waves, etc.), it requires significant assistance in terms of personnel, and any failure of the active depth control system may result in damage to, or loss of the LRT or its payload.

Systems for submerging work platforms and for supporting submerged work platforms during underwater activities are also known. In one system disclosed in U.S. Pat. No. 5,507,596, a support system for supporting a submerged work platform using one or more vessels uses a plurality of cables connected between the surface support vessel(s) and the underwater platform. Several individually controlled cables are used to provide a desired number of degrees of freedom of control vis a vis the work platform. The surface vessel(s) (e.g., ship(s) or barge(s)) are subject to surface sea motions, and the motions of the support structure(s) are sensed and the length of the cables is actively adjusted to maintain the work platform stationary, even as the support vessel(s) move at the sea surface.

Notwithstanding the existence of various launch and retrieval systems, and of various schemes for supporting underwater platforms, there remains a need for a simple vessel and payload launch and retrieval system that permits the safe deployment and retrieval of equipment and vessels in heavy sea conditions, and that does not require substantial vessel or personnel support or active depth control systems.

SUMMARY

Systems for launching and retrieving objects in aquatic environments, as disclosed herein, comprise a platform that is both floatable and submersible at the discretion of and/or under the control of a user, and on which objects to be launched and/or retrieved (referred to as the "payload") may be located. The system typically comprises a variable buoyancy, submersible platform that, in a buoyant, floating state, may be towed or shipped or otherwise maneuvered (e.g., propelled under its own power) to a desired site for submersion and launch or delivery of the object(s). The system additionally comprises one or more buoyant elements coupled to the submersible platform by means of one or more cable(s), line(s), chain(s) or other coupling mechanisms. The buoyant elements are typically in the form of one or more floats, optionally providing selectable buoyancy.

During an undersea deployment operation and following positioning of the platform at a desired deployment site, the platform is submerged under the control of a user and the one or more floatable element(s) coupled to the platform by means of the coupling mechanism(s) remain at or in proximity to the sea surface. The platform has a relatively large mass and, when submerged, acts as a dampener, while the buoyant element(s) and associated line(s)/cable(s)/coupling mechanism(s) act, relative to the submerged platform, as a classic spring. When the platform is submerged and the buoyant elements are separated from the platform and remain at or near the sea surface, the overall system acts as a classic spring mass dampener system, which may be represented in the graphical representation illustrated in FIG. 1 and mathematical terms, as shown below. The platform acts as the mass (M).

$$F_m + F_d + F_k = f(t)\frac{m}{g_c}\frac{d^2x}{dt^2} + c\frac{dx}{dt} + kx = f(t)$$

When the effective spring constant of the float element(s) is low, the input force from displacement of the float(s) caused by wave motion is also small relative to the size and weight of the platform and its payload. The mass and dampening effect of the platform dominates the motion of the platform under these conditions and counteracts the spring/float (and surface sea) disturbances. By properly sizing the buoyant elements for observed and predicted wave periods and heights, the float/platform system can maintain a submerged platform at a desired depth in a stable and substantially still condition, largely unaffected by surface waves and without requiring an active platform buoyancy or other active depth control systems.

Figure 1:
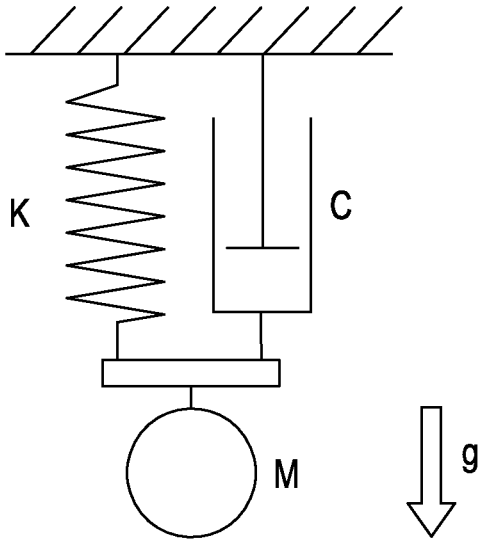
FIG. 1 shows a graphical illustration of the classical spring mass dampener system.

It will be understood that the appended drawings are not necessarily to scale, and that they present simplified, schematic views of many aspects of systems and components of the present invention. Specific design features, including dimensions, orientations, locations and configurations of various illustrated components may be modified, for example, for use in various intended applications and environments.

DETAILED DESCRIPTION

Systems and methods for launching and retrieving objects in aquatic environments and, particularly, for deploying payloads including submersible vehicles, equipment, systems, and the like, underwater and retrieving them from underwater locations are described in greater detail below, with reference to the appended figures. In general, a submersible platform may be provided in the form of a barge-like structure (or another platform structure) having a buoyancy control system, such as a ballast control system in combination with ballast reservoir(s) sufficient to provide floatation of the platform and its payload, controlled submersion of the platform to a desired subsea depth, and retrieval of the platform (with or without the payload) from a subsea location to the sea surface. The buoyancy control system may be controlled at the site of the submersible platform or from another vessel or location using remotely controllable ballast control systems. In some embodiments, the submersible platform may have single or multiple hulls that reduce the drag of the platform as it moves over or through the water. In some embodiments, the submersible platform may be designed and operated as a towed vessel or transported as cargo to locate it at a desired dive site; in other embodiments, the submersible platform may incorporate a propulsion system (and, optionally, a steering system) that assists, or independently propels the platform to a desired site. When the submersible platform is provided as (or as part of) an independently operable vessel, it may be controlled by an on-board operator, or it may optionally be controlled, at least in part, using remotely controlled operating systems. Suitable navigation, locational, operating and safety features, which are well known in the art, may be provided as part of or in conjunction with the submersible platform.

In general, the one or more buoyant or floatable elements (referred to as buoyant members or floats) may be mounted or mountable to lines/cables/chains (referred to, collectively, as "cables"). The buoyant members may be anchored to the submersible platform permanently, or one or more of such buoyant members may be releasably mountable to cables prior to submersion of the platform. In one embodiment, the one or more buoyant member(s) are releasably mounted to the platform under the control of a remotely operable release mechanism, such that a remote operator may selectively release one or more buoyant member(s) from an anchored condition on the platform prior to or during submersion of the platform, allowing the buoyant member(s) to remain on the surface during submersion of the platform. An appropriate length of coupling mechanisms (cables) may be released or paid out manually or automatically, such as via a remotely controlled system.

The platform or an assist vessel may carry different configurations or types of buoyant members designed for use in different sea conditions, and different floats may be mounted to the submersible platform prior to deployment based on the mass of the platform and payload, the salinity of the water at the dive site, current and/or anticipated sea conditions, and the like. In general, the one or more buoyant members may comprise conventional inflatable cylindrical buoys, sealed pipes or other enclosed structures filled with a gas or with a lightweight foam material, or the like. Variable buoyancy floats may also be provided, such as enclosed structures that have an adjustment feature providing variable buoyancy of the structures.

The submersible platform, in a buoyant and floating state, may be towed or shipped or otherwise maneuvered (e.g., under its own power) to a desired dive or payload launch site. The payload, which may include a manned or autonomous submersible vehicle or another type of submersible craft, a robotic vehicle or piece of equipment, another type of equipment or vehicle or platform for placement in a subsea location, may be mounted on the submersible platform prior to transit to the desired launch site and conveyed to the launch site on the submersible platform, or it may be mounted on the platform at the launch site. In an alternative operating scenario, the payload may be anchored to the submersible platform prior to a launch operation and the combination platform/payload may be submerged to a desired depth and towed to a desired launch site in a submerged or partially submerged condition. The payload is supported by the submersible platform during its descent from the sea surface or a sub-surface location and may be releasably connected to the submersible platform, for example under the control of a remotely operable release mechanism.

In one scenario, the payload is (or remains) positioned on the submersible platform, which is then located at a launch site as described above. The platform, with the payload attached, is submerged using a controlled buoyancy system (e.g., a ballast system) to a desired depth. One or more buoyant floats is released from the platform as the platform is submerged, and the float(s) remain at or near the sea surface, tethered to the submerged platform by a coupling mechanism. The comparatively large mass and dampening of the platform in the subsea location counteract and overcome the sea surface and spring/float disturbances to maintain a stable platform/payload condition. The payload may be released from the platform (e.g., manually by a diver or via remote control without requiring a diver) when the platform reaches a desired depth. The platform may return to the surface or remain submerged, awaiting a retrieval operation. Retrieval may be carried out as the reverse of the launch operation.

Figure 2:
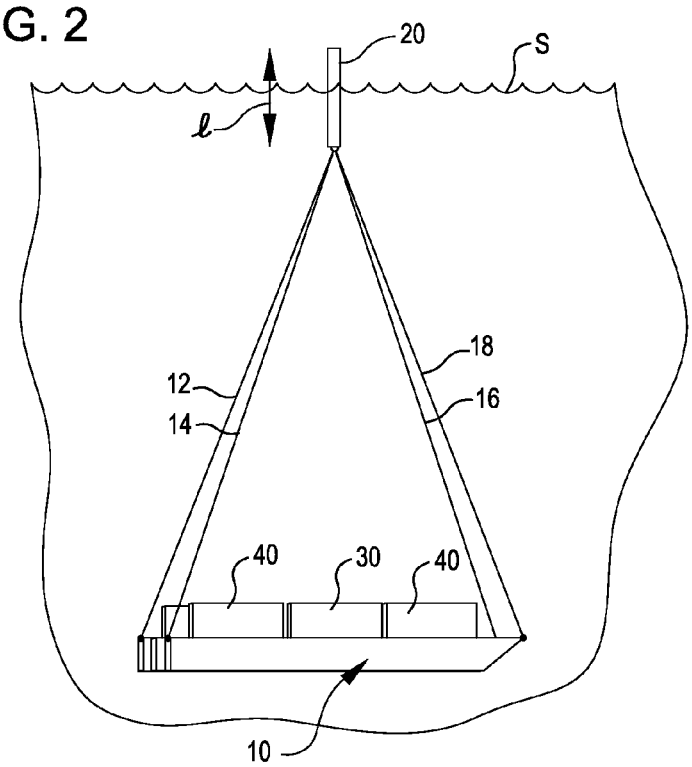
FIG. 2 shows a schematic drawing illustrating a platform in a submerged condition below a sea surface with a single buoyant element coupled to the platform.

FIG. 2 schematically illustrates a platform 10 in a submerged and supported condition below sea surface S, with a single buoyant element depicted as float 20 coupled to the submerged platform by means of a plurality of cables/lines/chains or equivalent supporting structures 12, 14, 16, 18 (referred to collectively as "cables"), or the like. Platform 10 is both floatable and submersible, under the control of a user. One or more ballast reservoirs 40, shown schematically, may be provided on or within platform 10 to provide flotation of the platform and its payload, as well as controlled submersion of the platform to a desired subsea depth. In some embodiments, ballast reservoirs 40 are remotely controllable at the site of the platform or from another vessel or location. Payload 30 is typically positioned on or within platform 10, and may be anchored to the platform during launch and retrieval. Payload 30 may comprise one or more submersible vehicles, various types of equipment, or the like, and for delivery to, storage at, and/or retrieval from an underwater location using systems and methods disclosed herein.

Float 20 shown in the illustrative embodiment of FIG. 2 preferably has sufficient buoyancy to support platform 10 and its payload 30 at a desired depth in a submerged condition and acts as a "spring" float in the platform/float system. Float 20 generally has a small surface area and/or footprint in comparison to the surface area and/or footprint of platform 10. By surface area, we mean the sum of external surface areas of the relevant float(s) and platform(s). By footprint, we mean the geometrical outline of space occupied by the object. In some embodiments, the surface area of float 20 is less than 50% of the surface area of platform 10; in some embodiments, the surface area of float 20 is less than 25% of the surface area of platform 10; in some embodiments, the surface area of float 20 is less than 10% of the surface area of platform 10; in yet other embodiments, the surface area of float 20 is less than 5%, or less than 1%, of the surface area of platform 10. In some embodiments, the footprint of float 20 is less than 50% of the footprint of platform 10; in some embodiments, the footprint of float 20 is less than 25% of the surface area of platform 10; in some embodiments, the footprint of float 20 is less than 10% of the surface area of platform 10; in yet other embodiments, the footprint of float 20 is less than 5%, or less than 1%, of the surface area of platform 10.

In one embodiment of a system as disclosed herein, the length (l) of float 20, oriented generally orthogonal to the sea surface when platform 10 is submerged (as shown in FIG. 2), is greater than the largest cross-sectional dimension of float 20. In some embodiments, the ratio of the length (l) of float 20 to its largest cross-sectional diameter is at least about 2:1; in some embodiments the ratio of the length (l) of float 20 to its largest cross-sectional diameter is at least about 5:1; in yet other embodiments, the ratio of the length (l) of float 20 to its largest cross-sectional diameter is more than about 5:1 and at least about 8:1. Float 20 may have a generally cylindrical, oval, rectangular or polygonal cross-sectional configuration. Float 20, illustrated in FIG. 2, has a substantially cylindrical configuration, with a uniform cross-sectional configuration and size over its length. In alternative embodiments, float 20 may have different cross-sectional configurations or cross-sectional surface areas over its length.

The coupling cables 12, 14, 16, 18 are generally mounted to a lower portion of the buoyant element 20 and coupled to the submersible platform 10 at two or more locations in a balanced arrangement to aid in supporting the platform in a stable, level condition during submersion of the platform, maintenance of the platform at depth, and deployment of the payload, retrieval and surfacing of the platform. Providing four (4) cables, with one attached near each corner of a rectangular platform 10, is illustrated in FIG. 2 and provides good stability and a balanced arrangement. It will be appreciated that alternative arrangements and cable anchoring positions may be implemented. In another embodiment, for example, when the platform 10 is generally rectangular, cables may be mounted at or near the midpoint of each side of the platform. Cables are generally flexible along their length and capable of supporting the platform and any associated payload at desired depths.

In another alternative embodiment, one or more substantially rigid coupling members may be provided to link one or more buoyant elements with the platform. In one exemplary embodiment, illustrated schematically in FIG. 3B, telescoping supports or posts 31, 33, 35, 37 that are mounted or mountable to the platform may be coupled to one or more appropriate buoyant elements 32, 34, 36, 38. The telescoping supports may be extended during submersion to a length corresponding to the submersion depth of the platform to couple the buoyant element(s) at the sea surface to the submerged platform, as illustrated. The telescoping supports operate in reverse during surfacing and retrieval of the platform.

Figure 3A:
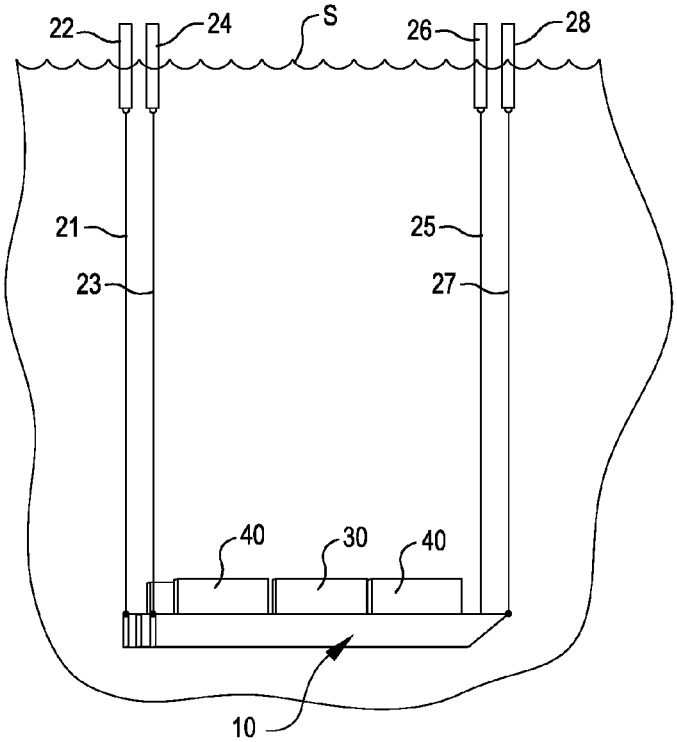
FIG. 3A shows a schematic drawing illustrating a platform in a submerged condition below a sea surface with multiple buoyant elements coupled to the platform.
Figure 3B:
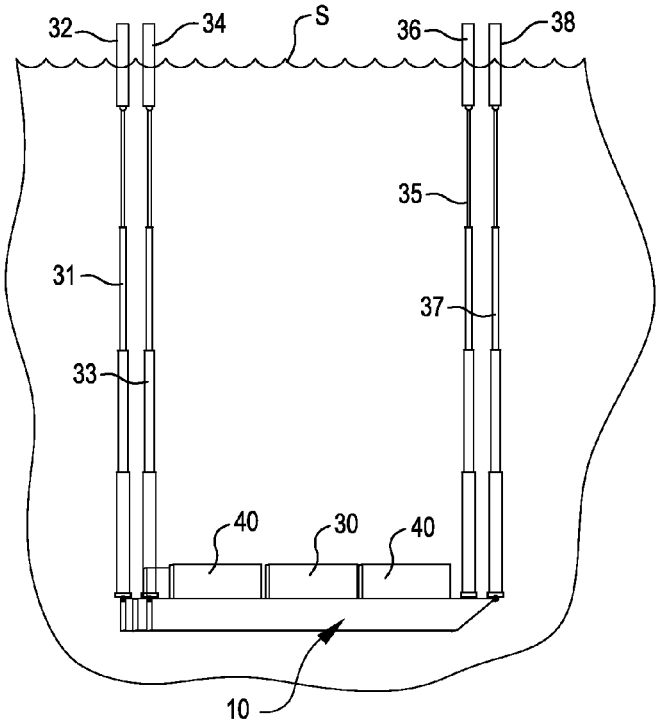
FIG. 3B shows a schematic drawing illustrating a platform in a submerged condition below a sea surface with multiple buoyant elements coupled to the platform by means of telescoping supports or posts.
Figure 3C:
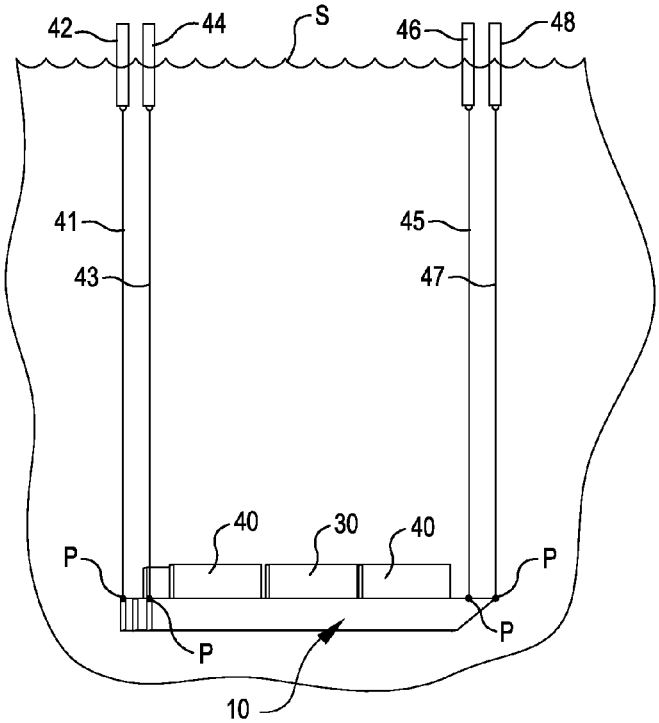
FIG. 3C shows a schematic drawing illustrating a platform in a submerged condition below a sea surface with multiple buoyant elements coupled to the platform by means of rigid linking in members.

In another exemplary embodiment, illustrated schematically in FIG. 3C, rigid coupling or linking members 41, 43, 45,47 may be mounted or mountable to the platform in a hinged or pivoting relationship at pivot points P, allowing re-positioning of the linking members from a substantially horizontal to a substantially vertical condition as the platform is submerged and vice-versa as the platform re-surfaces. In some embodiments, coupling supports that are both telescoping (as illustrated in FIG. 3B) and pivoting (as illustrated in FIG. 3C) may be provided.

In some embodiments, the platform and payload are suspended in a neutral to slightly negative buoyancy condition when submerged, with the buoyant members supporting the platform and payload in a slightly negative buoyancy condition. Variable conditions at desired dive sites, such as salinity, sea surface conditions, turbulence, wave height and frequency, and the like may be taken into consideration in matching a float system comprising one or more floats to support a desired platform and payload combination at a desired depth in a desired neutral to slightly negative buoyancy condition.

In some embodiments, as previously described the platform and payload is suspended by multiple spring floats coupled to the platform by coupling mechanisms. One example of this type of system is illustrated schematically in FIG. 3A. In this example, platform 10 is supported in a submerged condition by multiple buoyant members 22, 24, 26 and 28. Float cables 21, 23, 25, 27 anchor floats 22, 24, 26 and 28 to the platform independently of one another, which may reduce the risk of entanglement with the payload when the payload is released at or returned to the platform at depth. In alternative embodiments, the coupling mechanisms and/or multiple floats may be loosely coupled to one another. In the exemplary embodiments illustrated in FIGS. 3A-3C, four floats are provided, and each is coupled to the submersible platform in proximity to a corner of the platform. Additional floats and coupling mechanisms may be provided in yet alternative embodiments.

Figure 4:
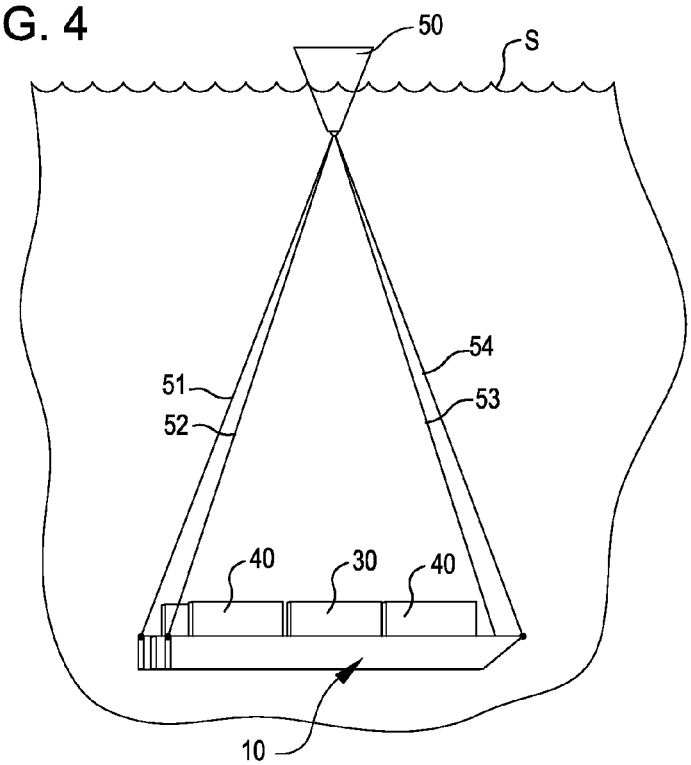
FIG. 4 shows a schematic drawing illustrating a platform in a submerged condition below a sea surface with a single buoyant element having an inverted conical configuration coupled to the platform.

Another exemplary embodiment of a similarly submerged and suspended work platform 10 is shown in FIG. 4. This system is similar to the system described above and includes a float 50 having a generally conical configuration. Conical float 50 may be positioned and oriented with the larger cross-sectional and/or surface area portion of the float in an upper position (as shown in FIG. 4) above or nearer to the sea surface, with the smaller cross-section and/or surface area portion of the float in a downward-oriented arrangement, at or below the sea surface. A plurality of coupling mechanisms (e.g., cables 51, 52, 53 54) may be provided to couple float 50 to the platform 10. The coupling mechanisms may be mounted to the lower portion of the float, as shown. The use of a float having a configuration in which a larger surface area is above the sea surface and a smaller surface area is below the sea surface when a platform and payload is submerged may provide a dampening moment with more precise depth control of the system.

Figure 5:
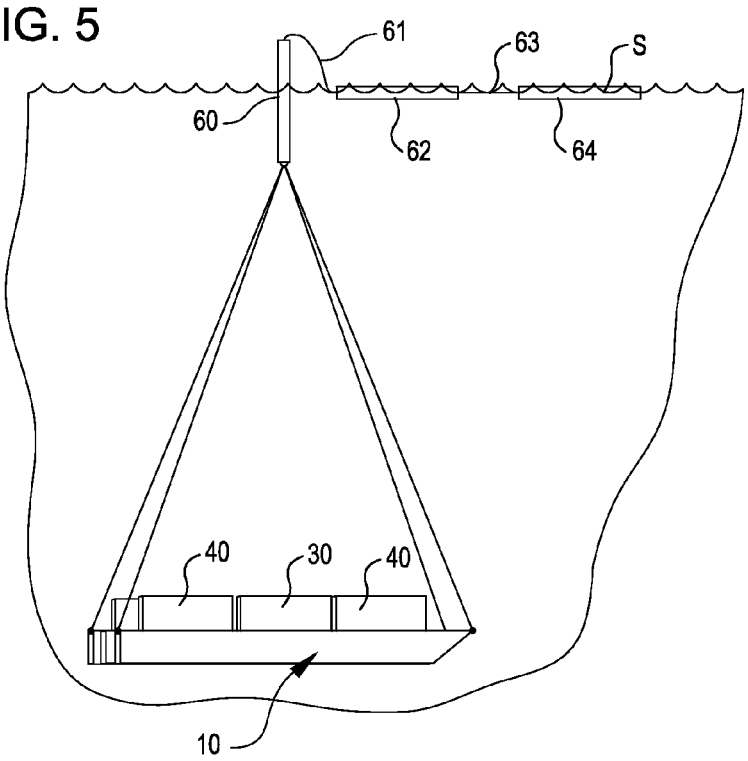
FIG. 5 shows a schematic drawing illustrating a platform in a submerged condition below a sea surface with multiple buoyant elements coupled to the platform.

In yet another embodiment, multiple spring floats may be coupled to one another to provide a desired buoyancy and may provide flexibility for slightly varying net negative buoyancy of the platform and payload. In circumstances where the desired spring constant is low and the net negative buoyancy of the load is not precisely determinable, this arrangement provides a known spring force without requiring an overly long or top heavy spring float. One example of a system of this type is illustrated schematically in FIG. 5. In this embodiment, a first buoyant element 60 is coupled to additional buoyant elements 62, 64 by means of connecting elements 61, 63, such as cables or lines. Buoyant elements may be configured and arranged to provide buoyancy in different orientations and may be provided in different configurations than those shown. In the embodiment illustrated, float 60 is oriented in a substantially vertical orientation while supporting a submerged platform, while floats 62 and 64 are oriented in substantially horizontal orientations. In this system, the buoyant members have a buoyancy that supports them and the submerged platform and payload in a stable location below the sea surface during deployment or retrieval of the platform in a subsea location.

In some embodiments, the spring float(s) may act as passive spring elements in the spring mass dampener system where the submersible platform serves as a large mass dampener. In alternative embodiments, the float may be supplemented by an active control system that is capable of detecting sea surface changes and automatically feeds out and takes in the coupling mechanism (line, chain, cable, etc.) as the float encounters sea surface disturbances. An inertial reel, an electric or hydraulic motor may be used as an active float positioning control mechanism. In general, no active platform buoyancy or other active depth control system is required to support the submersible platform in the submerged condition as a result of the deployment of one or more coupled float(s) at or near the sea surface. In some embodiments, however, it may be desirable to incorporate an active platform buoyancy or another active depth control system.

In the description provided above, the term "about" means +/−20% of the indicated value or range unless otherwise indicated. The terms "a" and "an," as used herein, refer to one or more of the enumerated components or items. The use of alternative language (e.g., "or") will be understood to mean either one, both or any combination of the alternatives, unless otherwise expressly indicated. The terms "include" and "comprise" are used interchangeably and both of those terms, and variants thereof, are intended to be construed as being non-limiting.

It will be appreciated that the methods and systems of the present invention may be embodied in a variety of different forms, and that the specific embodiments shown in the figures and described herein are presented with the understanding that the present disclosure is considered exemplary of the principles of the invention, and is not intended to limit any claimed subject matter to the illustrations and description provided herein. The various embodiments described may be combined to provide further embodiments. The described devices, systems, methods and compositions may omit some elements or steps, add other elements or steps, or combine the elements or execute steps in a different order than that specifically described.

I claim:

1. A system for launching objects in an aquatic environment, comprising: a platform having a buoyancy control system providing floatation and submersion of the platform under the control of a user, and at least one float coupled to the platform and adapted to remain at or in proximity to a surface of the aquatic environment when the platform is submerged, wherein the at least one float is coupled to the platform by means of a plurality of cables, lines or chains coupled to the submersible platform at two or more locations, and the at least one float is capable of supporting the platform in a stable condition at a desired depth below the surface of the aquatic environment in the absence of an active depth control system.

2. The system of claim 1, wherein the at least one float has a ratio of length:largest cross-sectional diameter of greater than 5:1.

3. The system of claim 1, comprising at least four floats.

4. The system of claim 1, wherein the at least one float has a generally conical configuration.

5. The system of claim 1, wherein the at least one float comprises a plurality of floats linked to one another.

6. The system of claim 1, wherein the buoyancy control system comprises at least one ballast tank and a ballast control system sufficient to float and submerge the platform to a desired subsea depth.

7. The system of claim 6, wherein the ballast control system is remotely controllable from a location other than the platform.

8. The system of claim 1, additionally comprising a detachable mounting system for detachably connecting a payload to the platform.

9. The system of claim 8, wherein the detachable mounting system is remotely controllable from a location other than the platform.

10. The system of claim 1, wherein the at least one float is releasably mounted to the platform when the platform is not submerged.

11. A method for launching an object in an aquatic environment, comprising: detachably mounting the object to be launched or placed in a subsea location on a platform having a buoyancy control system providing controllable floatation and submersion of the platform; locating the platform and the detachably mounted object at a desired sea surface launch location; submerging the platform and detachably mounted object at the desired launch location to a desired launch depth while retaining at least one float coupled to the platform at the sea surface launch location, supporting the submerged platform in a stable condition in the absence of an active depth control system; and detaching the object from the platform at the desired launch depth.

12. The method of claim 1, wherein the at least one float supplies a desired spring constant in a spring mass dampener system in which the submerged platform acts as a dampener.

13. The method of claim 1, wherein the object detachably mounted to the platform is selected from the group consisting of: a manned submersible vehicle, an unmanned submersible vehicle, a submersible craft, a robot vehicle, a piece of equipment, and a platform.

14. The method of claim 11, additionally comprising selectively releasing at least one float from an anchored condition on the platform prior to or during submersion of the platform.

15. A system for launching objects in an aquatic environment, comprising: a platform having a buoyancy control system providing controllable floatation and submersion of the platform under the control of as user, and a plurality of floats coupled to the platform and adapted to remain at or in proximity to a surface of the aquatic environment when the platform is submerged, wherein each of the plurality of floats is coupled to the platform by means of at least one substantially rigid linking member, and wherein the plurality of floats is capable of supporting the platform in a stable condition at a desired depth below the surface of the aquatic environment in the absence of an active depth control system.

16. The system of claim 15, wherein the at least one substantially rigid linking member is a telescoping member.

17. The system of claim 15, wherein the at least one substantially rigid tiding member is pivotally mounted in relation to the platform.

18. The system of claim 15, wherein the at least one float is capable of supporting the platform in a stable condition at a desired depth below the surface of the aquatic environment in the absence of an active depth control system.

19. The system of claim 15, additionally comprising, a remotely controllable detachable mounting system for detachably connecting a payload to the platform.

20. The system of claim 15, comprising at least four floats.

* * * * *